US010758028B2

(12) United States Patent
Corbellini et al.

(10) Patent No.: US 10,758,028 B2
(45) Date of Patent: Sep. 1, 2020

(54) DISPOSABLE PACKAGE FOR A FROZEN PERSONAL CARE PRODUCT

(71) Applicant: ELC Management LLC, Melville, NY (US)

(72) Inventors: Francis Corbellini, Thiais (FR); Herve F. Bouix, New York, NY (US); Loretta A. Miraglia, Blauvelt, NY (US); Robin Shandler, Jersey City, NJ (US); Natalie Chan, Brooklyn, NY (US); Stephanie DeLuca, Astoria, NY (US)

(73) Assignee: ELC MANAGEMENT LLC, Melville, NY (US)

( * ) Notice: Subject to any disclaimer, the term of this patent is extended or adjusted under 35 U.S.C. 154(b) by 432 days.

(21) Appl. No.: 15/832,974

(22) Filed: Dec. 6, 2017

(65) Prior Publication Data

US 2019/0166978 A1 Jun. 6, 2019

(51) Int. Cl.

| | |
|---|---|
| ***A46B 11/00*** | (2006.01) |
| ***A45D 40/28*** | (2006.01) |
| ***B65D 75/52*** | (2006.01) |
| ***B65D 75/36*** | (2006.01) |
| ***A45D 40/00*** | (2006.01) |

(52) U.S. Cl.
CPC ..... *A45D 40/28* (2013.01); *A45D 40/0087* (2013.01); *B65D 75/367* (2013.01); *B65D 75/527* (2013.01); *A45D 2040/0012* (2013.01)

(58) Field of Classification Search
CPC .. A45D 40/0087; A45D 40/28; B65D 75/367; B65D 75/527
USPC ..... 401/130
See application file for complete search history.

(56) References Cited

U.S. PATENT DOCUMENTS

| | | | | |
|---|---|---|---|---|
| 2,946,207 | A | 7/1960 | Hulterstrum | |
| 4,378,025 | A | 3/1983 | Gaston | |
| 7,097,626 | B2 * | 8/2006 | Louis | A61H 7/003 601/135 |
| 7,478,962 | B2 * | 1/2009 | De Laforcade | A45D 40/0087 401/202 |
| 8,777,504 | B2 * | 7/2014 | Shaw | A61B 90/70 401/202 |
| 8,783,451 | B2 * | 7/2014 | Slokovic | A61P 17/02 206/209 |

FOREIGN PATENT DOCUMENTS

WO WO-2008131804 A1 * 11/2008 ..... A45D 40/0087

* cited by examiner

*Primary Examiner* — Jennifer C Chang
(74) *Attorney, Agent, or Firm* — Peter Giancana

(57) ABSTRACT

A disposable unit dose package for frozen cosmetic or personal care products that can provide a chilling effect during application. The main components of the package are a reservoir and an applicator. The reservoir may be interiorly divided to hold more than one product. The applicator comprises a handle and one or more applicator heads depending from the handle. In use, a product in the reservoir is frozen, which causes the product to bond to the applicator head. The handle is used to lift the frozen product out of the reservoir, and draw the frozen product over the skin. As it melts from the heat of the skin, the product can be spread on the skin.

11 Claims, 14 Drawing Sheets

DISPOSABLE PACKAGE FOR A FROZEN PERSONAL CARE PRODUCT

FIELD OF THE INVENTION

The invention is in the field of unit dose packaging for cosmetic or personal care products. More specifically, we disclose a disposable package that is designed to house and apply frozen cosmetic or personal care products that can provide a chilling effect during application.

BACKGROUND OF THE INVENTION

For the convenience of the cosmetic user, cosmetic packaging often includes an applicator that is suitable for dispensing the particular cosmetic contained in the package reservoir. The applicator head or applicator tip is used to apply and spread the applied product, and may additionally serve to massage the skin of the user in the application area. It is also believed that cooling the skin can have a beneficial effect. For example, cooling the skin area below the eyes has been shown to reduce puffiness. In the past, applicator heads and applicator tips having a variety of shapes and configurations have been provided with means for cooling, but the effectiveness has generally been limited by the relatively small thermal mass of the components and by other limitations. Alternatively, pre-chilled creams or lotions, or chilled washcloths or cleansing pads have been used to reduce skin temperature, but not necessarily in convenient, single does forms, and the product, while chilled, may provide only a limited cooling effect. In contrast, a frozen product can deliver a much more significant chilling effect to the skin, than a merely chilled product or product applicator.

U.S. Pat. No. 4,378,025 describes cosmetic products in the form of deep-frozen blocks or cakes, which are directly applicable to the skin. The relatively large blocks are molded around supports (sticks for example) made from wood, plastic material, whose ends projecting from the block will enable them to be easily handled. A user is able to withdraw the deep-frozen block from its mold without contact with the cosmetic substance. The process for packing the described blocks consists in pouring or compressing the cosmetic substance in a mold, and in cooling the substance rapidly and intensively to a complete deep-freeze, i.e. between −25° C. and −80° C. The relatively large blocks allow multiple applications with the block being returned to a freezer for storage between uses. A drawback of the '025 invention is the need to remove the entire block of cosmetic product from the freezer. Now, the block is so large such that, in a single application, only a small portion of the surface of the bock will ever contact the skin. The result is that some product near the surface of the block melts, but is not deposited on the skin. The amount of melting may be significant if the product block spends several minutes or longer out of the freezer. Subsequently, this melted product is returned to the freezer, thus being subject to at least one freeze thaw cycle (and probably several freeze thaw cycles) before it will actually be applied to a user's skin on some future application. On the one hand, the portion of product that was subject to at least one freeze thaw cycle may be degraded in appearance, or texture, or efficacy of its active ingredients or any combination thereof. Clearly then, thawing and refreezing any amount of the product should be avoided. On the other, depending on its melting point temperature and consistency, the melted product that does not get deposited on the skin may run down the handle or onto the hand of the user, or otherwise drip and create a messy situation.

Accordingly there is a need for unit dose packaging for cosmetic or personal care products wherein the package is designed to house and apply a single dose of frozen cosmetic or personal care products that can provide a significant chilling effect during application, while avoiding degradation of the product due to freeze-thaw, and avoiding the other problems described above.

SUMMARY OF THE INVENTION

The main components of the invention are a reservoir and an applicator. The reservoir may be interiorly divided to hold more than one product. The applicator comprises a handle and one or more applicator heads depending from the handle. The surface of the applicator head is contoured, embossed and/or dimpled. When not in use, the reservoir houses one or more products and one or more applicator heads. In use, a product in the reservoir is frozen, which causes the product to bond to the applicator head. The handle is used to lift the frozen product out of the reservoir, and draw the frozen product over the skin. As it melts from the heat of the skin, the product can be spread on the skin. Once all or enough product has melted off of the applicator head, the contoured surface of the applicator head contacts the skin, and is able to provide one or more effects, such as a massage effect, an exfoliation effect, an effect of driving active ingredients into the skin, etc.

DETAILED DESCRIPTION

The Reservoir (1)

The first main and essential component of the invention is a reservoir (1) that is able to be filled with and retain a personal care product (P) that is a liquid or semi-liquid at standard atmospheric pressure and temperature, and that freezes at lower temperatures. Many types of personal care products will freeze at temperatures substantially close to 0° C., but those that freeze at higher or lower temperatures may also be useful. The reservoir should be able to withstand product expansion and contraction without rupturing. It should also be non-reactive with the products that it is intended to hold. To that end, reservoirs of the invention may be fashioned out of elastic materials, such as thermoplastic elastomers or silicone rubbers. The reservoir components described herein, may be fashioned from these materials by various molding techniques, such as injection molding.

Figure 1:
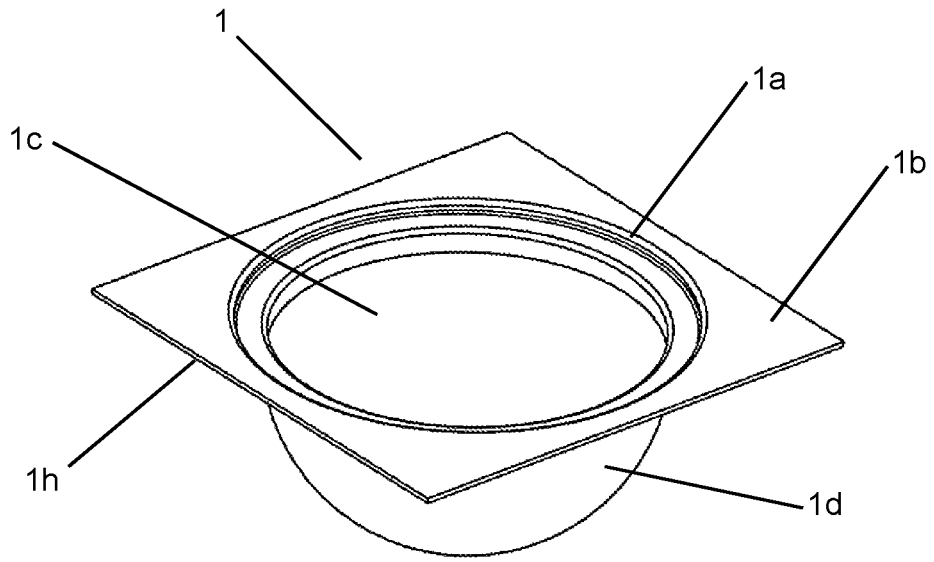
FIGS. 1-7 depict various embodiments of a product reservoir (1) according to the invention.
Figure 10:
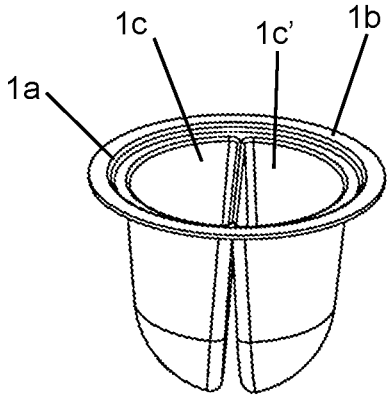
FIGS. 10 and 11 depict reservoirs (1) that comprise two or three interior spaces.
Figure 11:
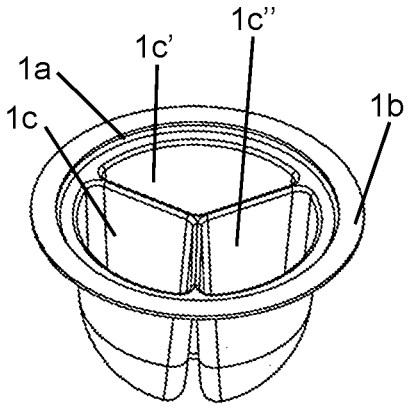

Referring to FIG. 1, one preferred set of embodiments of the reservoir (1) includes thin walled hemispheres that are opened at the hemispherical plane. Other embodiments are possible, in which the reservoir is not hemi-spherical, conic (see FIG. 2) or oval or egg-shaped, or in which the opening into the reservoir is not circular. Either way, a reservoir of the invention comprises a wall (1*d*) and a perimeter (1*a*) that defines an opening in the wall. The perimeter extends outwardly into a flange (1*b*). The reservoir comprises a single interior space (1*c*) that is defined by the wall, or the reservoir may be divided in its interior into two or more spaces (1*c*, 1*c*', 1*c*"). Reservoirs that comprise two or three interior spaces are shown in FIGS. 10 and 11. For a reservoir that comprises two or more interior spaces, each space may hold the same or a different personal care product. As shown in FIGS. 10 and 11, even though there is more than one interior space, the opening of the reservoir is bounded by a single perimeter (1*a*) and flange (1*b*), which rise slightly above the two or more interior spaces.

All or a portion of the wall (1*d*) of the reservoir may be opaque, translucent or transparent.

The interior space (1*c*) of the reservoir (1) has a volume that is occupied by the one or more personal care products, as well as the applicator head (4) of an applicator (2) according to the present invention. The amount of volume taken up by the one or more personal care products is enough for at least one complete application of the product according to its intended use. As an example, in some embodiments, one application of a face product may require from 1 mL to 7 mL, while one application of a body product may require from 7 mL to 20 mL.

Figure 3:
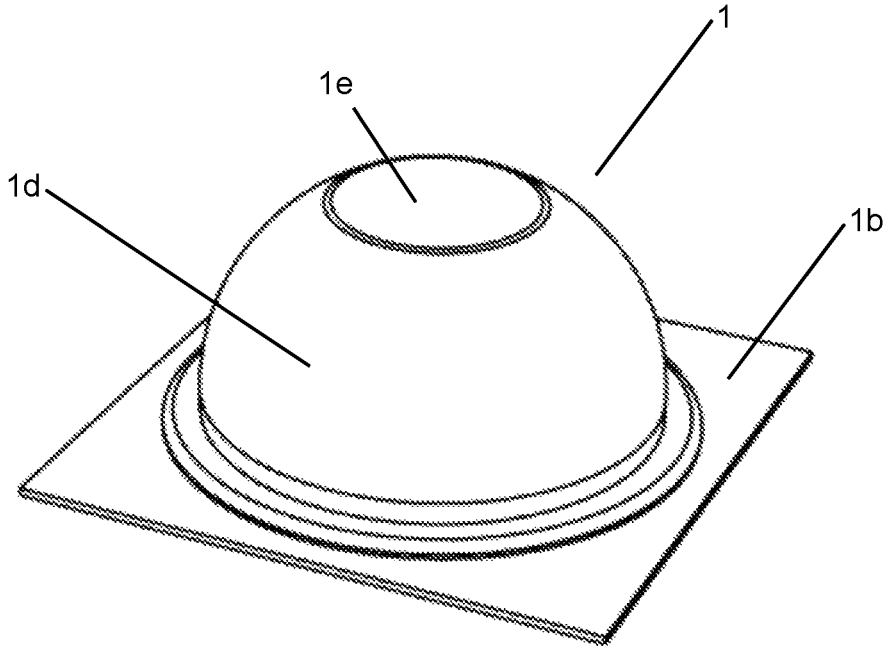
Figure 4:
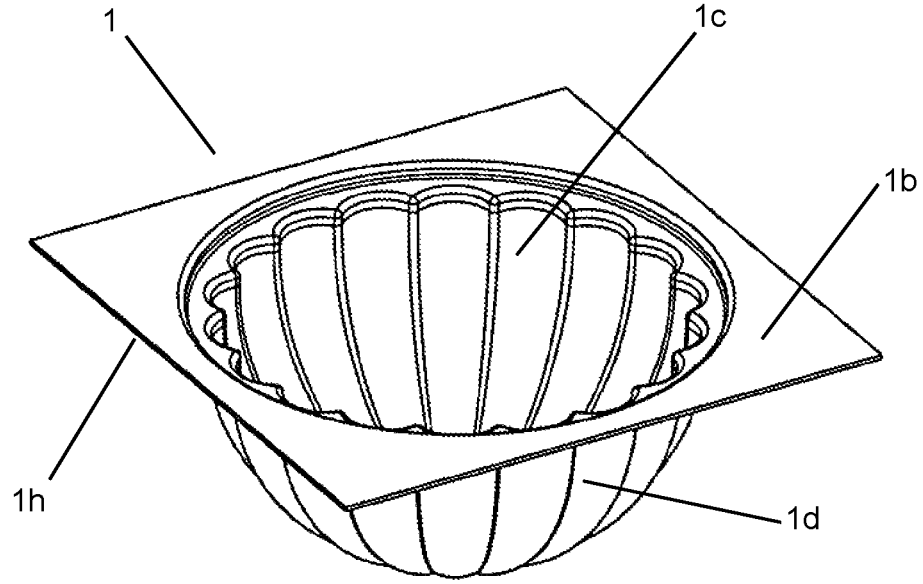
Figure 5:
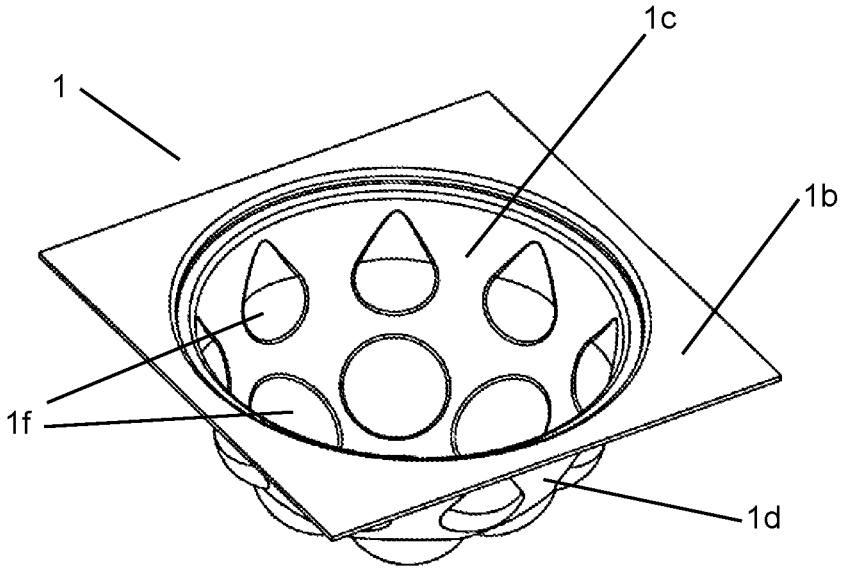
Figure 6:
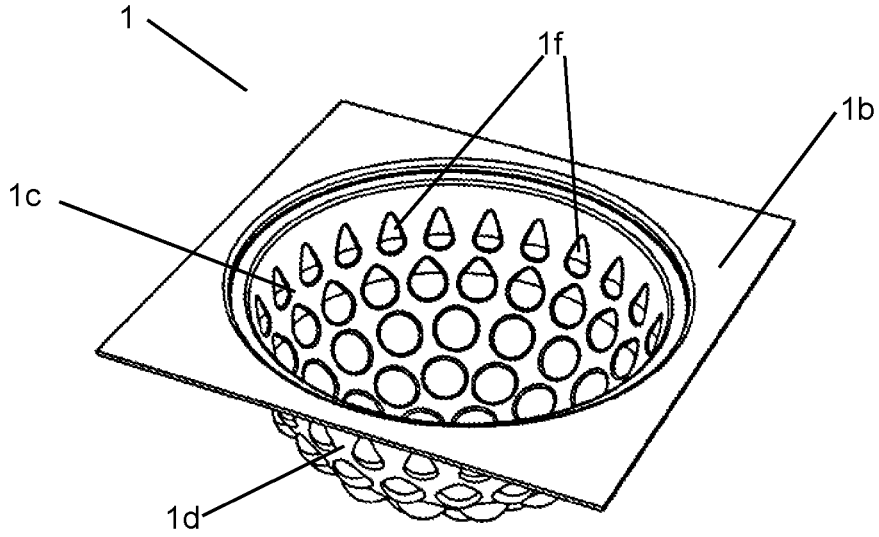
Figure 7:
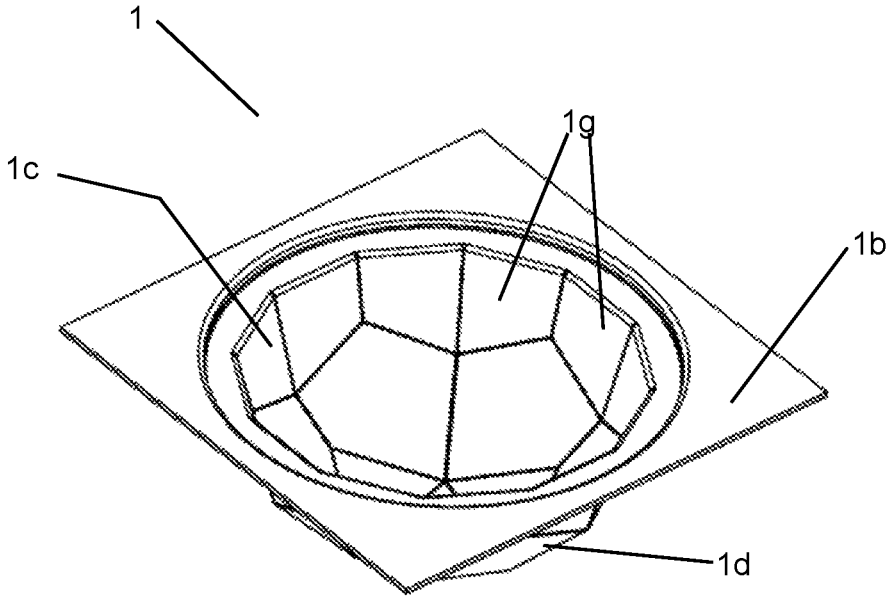

The interior surface of the wall (1*d*) of the reservoir (1) should be free of surface features that would significantly inhibit the removal of the frozen personal care product from the reservoir. On the other hand, any surface features on the interior surface of the wall of the reservoir would produce complementary features on the surface of the frozen product. Such surface features on the frozen product are optional, but may be desirable. Examples of surface features on the interior surface of the wall of the reservoir are shown in FIGS. 3-7. For example, the otherwise hemi-spherical reservoir of FIG. 3 is provided with a flattened base (1*e*). In FIG. 4, the interior surface of the reservoir is scalloped, while in FIGS. 5 and 6, the interior surfaces bear a number of circular and tear-drop shaped indentations (1*f*). As a another non-exhaustive optional example, the interior surface of the reservoir may be comprised of a number of polygonal facets (1*g*) (FIG. 7). Combinations of these are also possible.

Figure 2:
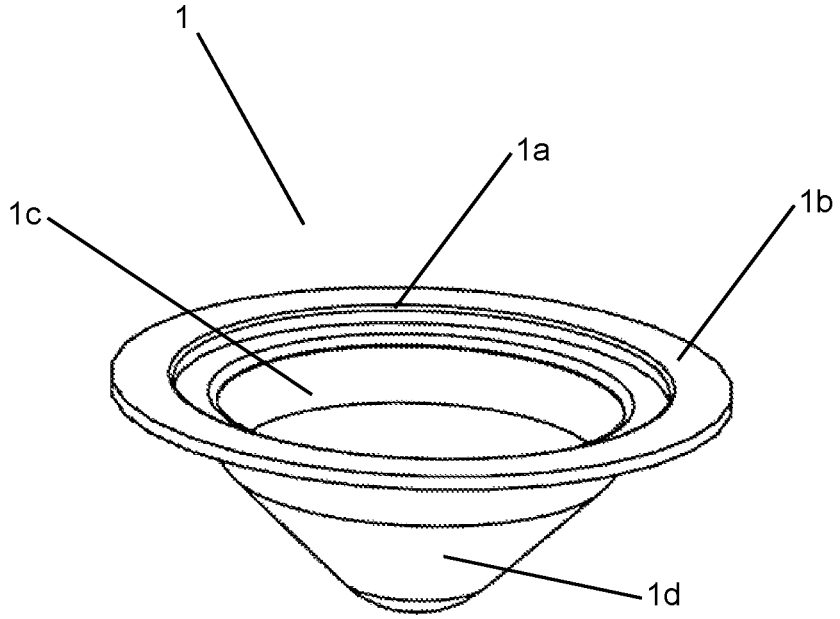
Figure 8:
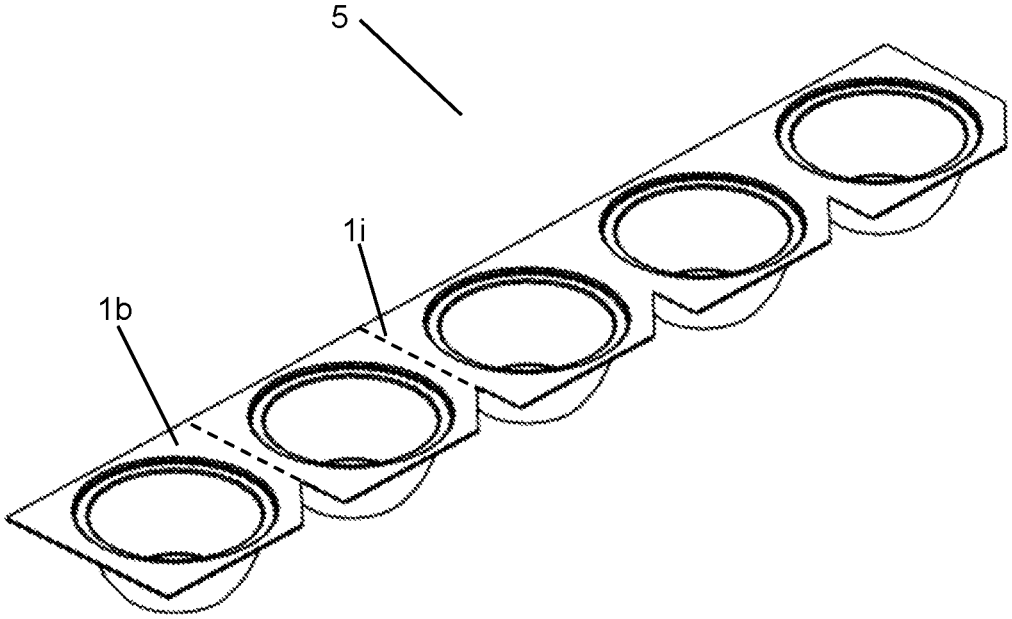
FIG. 8 depicts multiple reservoirs (1) that are joined together into a strip (5)
Figure 9:
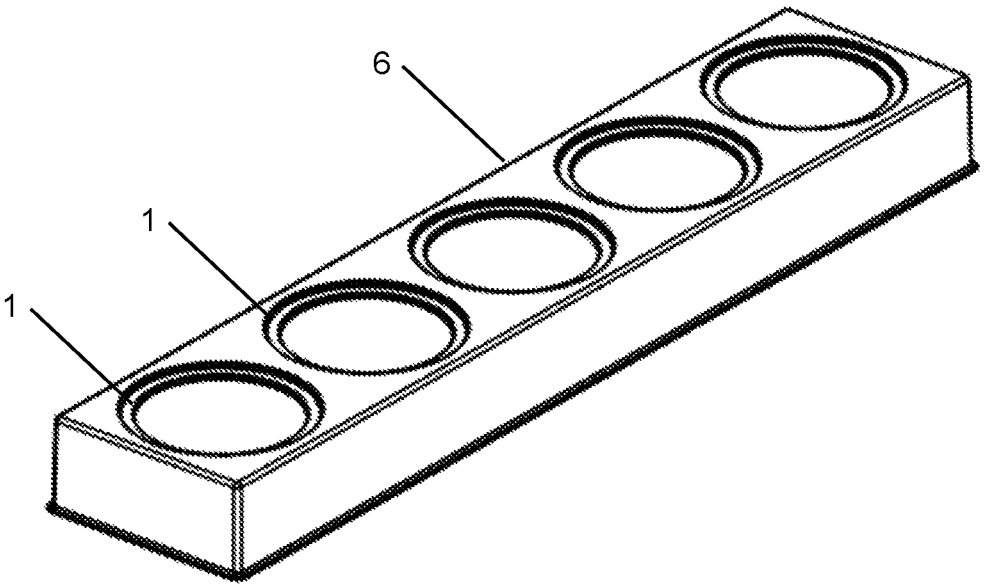
FIG. 9 depicts an optional tray (6) which is designed to house multiple disconnected reservoirs (1).

With the exception of FIG. 2, the reservoirs (1) depicted in FIGS. 1-7 have a flange (1*b*) that extends out into a square perimeter. A useful purpose of this feature is the ability to join multiple unit dose packages together into sets of two or more packages. According to this embodiment of the invention, each reservoir has a flange with at least one straight edge (1*h*). Multiple reservoirs that have flanges with at least one straight edge (1*h*) can be joined together into single strips (5, FIG. 8) or a grid of columns and rows. The reservoirs may be joined with or without a breakaway feature (1*i*), as shown in FIG. 8, which allows individual reservoirs to be separated from the strip. In contrast, the flange of the reservoir of FIG. 2 does not have at least one straight edge, and is not intended to be joined directly to other reservoirs. However, FIG. 9 depicts an optional tray (6) which is designed to house a set of disconnected unit does packages (and can be used even if the reservoirs have one or more straight edges).

Figure 12:
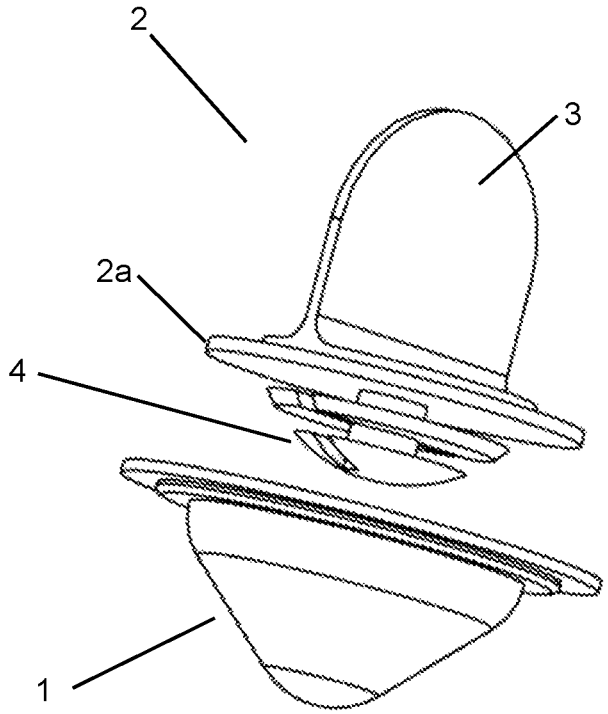
FIG. 12 is one embodiment of an applicator (2) that comprises a handle (3) and an applicator head (4), and that is designed to be used with the reservoir (1).
Figure 13:
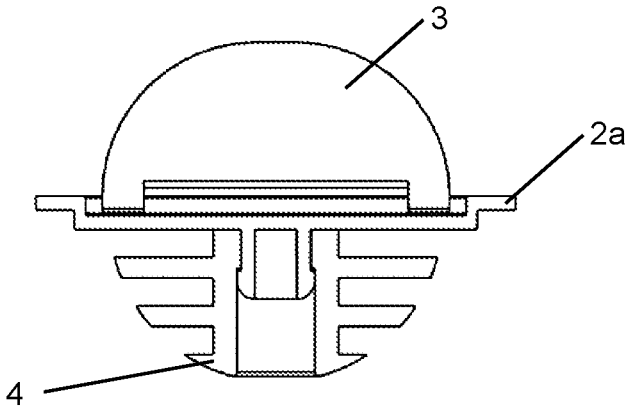
FIGS. 13-16 show various means of joining the handle (3) and applicator head (4).
Figure 14:
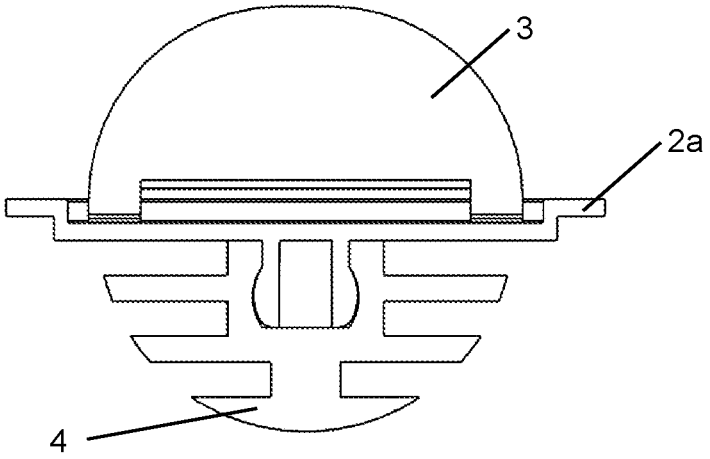
Figure 15:
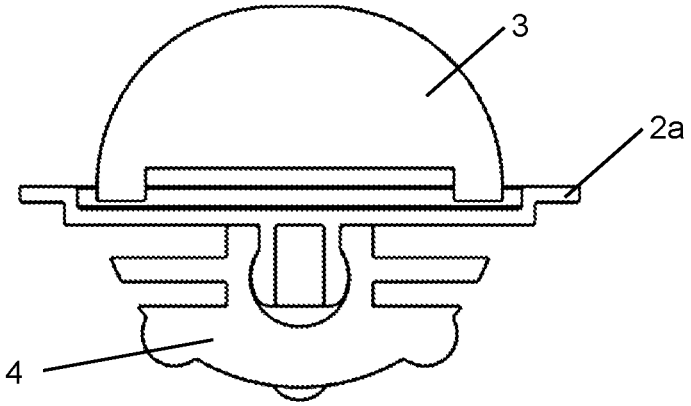
Figure 16:
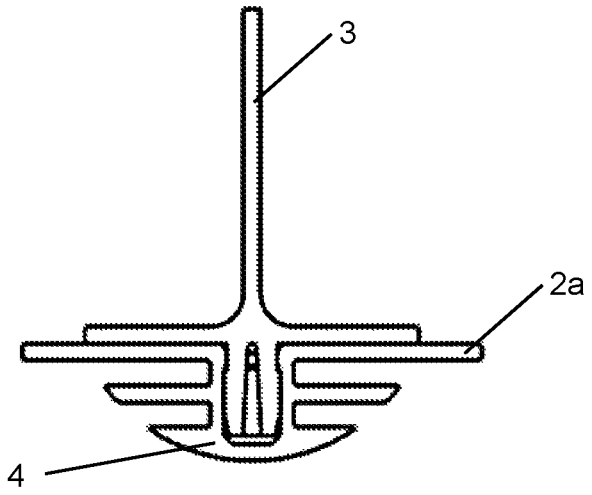
Figure 17:
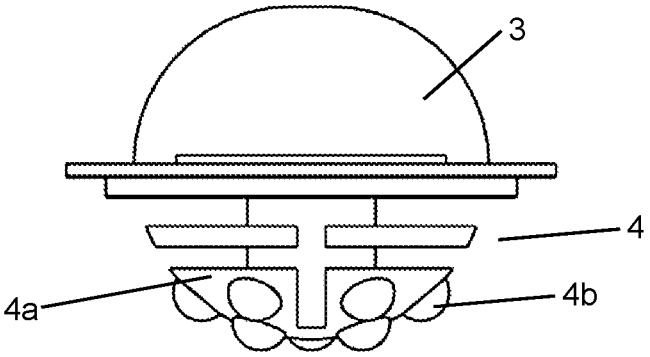
FIGS. 17-19 show some non-limiting examples of the applicator head (4).
Figure 18:
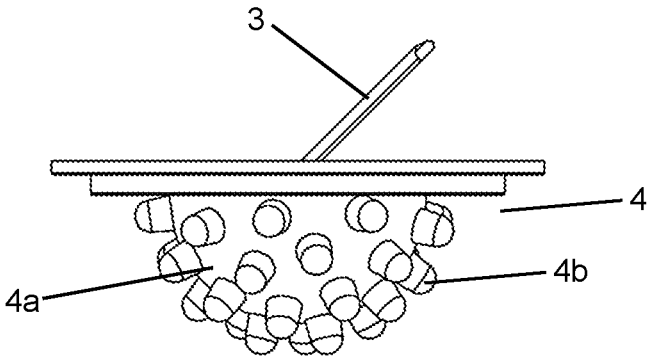
Figure 19:
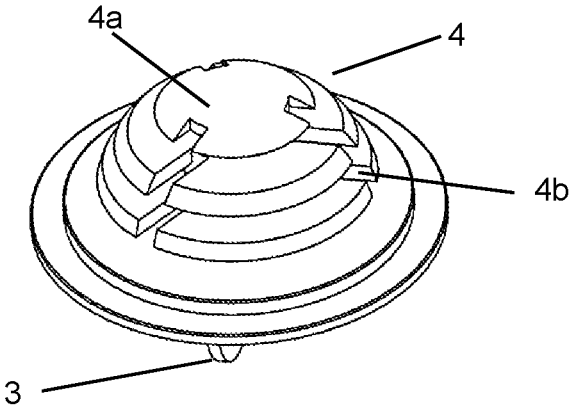

The applicator (2) comprises a handle (3) and one or more applicator heads (4) depending from the handle. Referring to FIG. 12, the handle is an elongated part of the applicator that is grasped by a user during intended use of the package. A typical handle is large enough to be firmly grasped between the thumb and pointer finger, such that the applicator can be drawn across the surface of the skin without difficulty. The handle may be any convenient shape, such as a rectangular or semi-circular. Also, the handle is preferably rigid which increases control of the applicator during use. The handle will typically be molded in a sufficiently stiff plastic.

The applicator head (4) depends from the handle (3), and is designed to hold the frozen personal care product (P). For ease of application, the connection between the handle and applicator head is preferably rigid. The applicator head and handle may be integrally molded out of one material, as shown in FIG. 12. Alternatively, the applicator head and handle may be fashioned separately out of the same or different material, and later joined together. Means of joining may include friction or snap fit as shown in FIGS. 13-16, as well as adhesive and welding. FIGS. 12-23 depict stiff, plastic molded applicator heads, while sponge embodiments are discussed further below.

To ensure that the frozen product (P) adheres to the applicator head (4), the outer surface (4*a*) of a applicator head is provided with contours and/or textural features (4*b*) that are able to increase the adherence of the frozen product to the bare applicator head. By "bare applicator head" we mean an applicator head (4) that has little or no product (P) adhered to it, either because the applicator head has not yet been immersed in a product reservoir (1), or because the product has been depleted from the applicator head, creating bare spots that are able to contact the skin of a user. Examples of textural features include grooves, indentations and raised dimples, as shown in the non-limiting examples of FIGS. 17-19. The applicator head may have any combination of such textural features in varying numbers.

Figure 20:
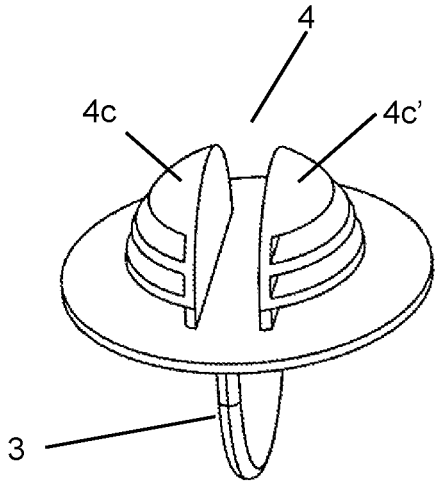
FIG. 20 shows an applicator head (4) divided into two sections (4*c*, 4*c*'
Figure 21:
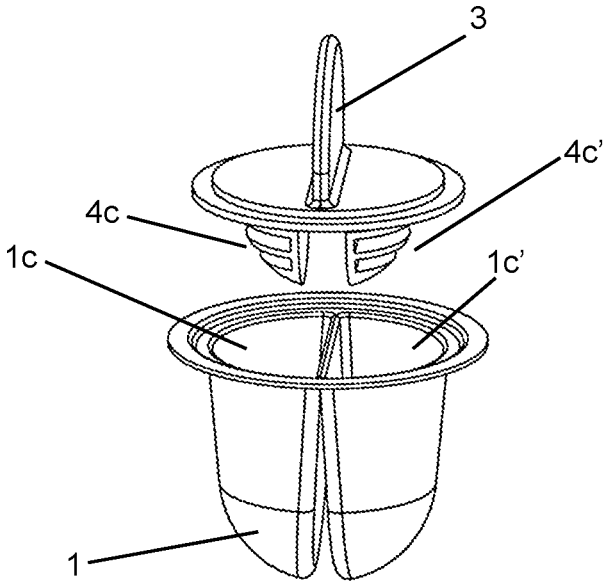
FIG. 21 shows how the applicator head of FIG. 20 would be positioned to fit into a reservoir (1) having two interior spaces (1*c*, 1*c*').
Figure 22:
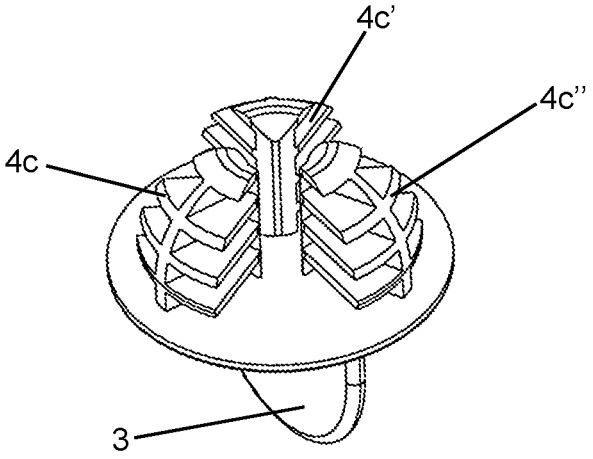
FIG. 22 shows an applicator head (4) divided into three sections (4*c*, 4*c*', 4*c*")
Figure 23:
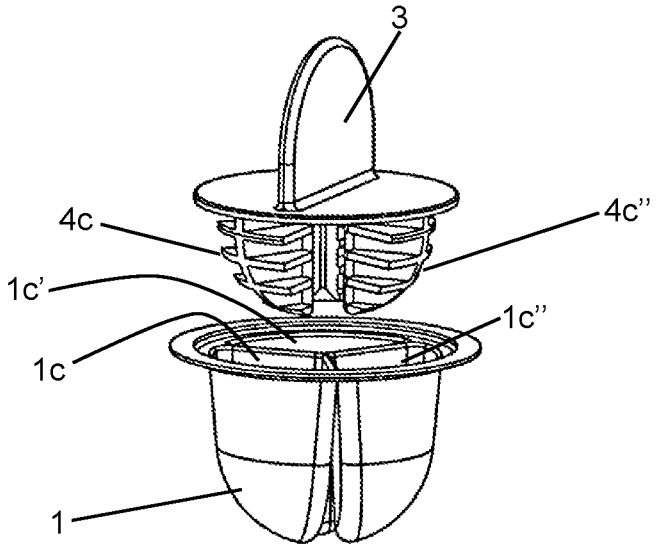
FIG. 23 shows how the applicator head (4) of FIG. 22 would be positioned to fit into a reservoir (1) having three interior spaces (1*c*, 1*c*', 1*c*").

The bare applicator head (4) is small enough to fit into the reservoir (1). Preferably, the applicator head is divided into as many sections as there are interior spaces (1*c*, 1*c*', 1*c*") of the reservoir, so that each interior space of the reservoir houses a section of the applicator head. FIG. 20 shows an applicator head divided into two sections (4*c*, 4*c*'). FIG. 21 shows how this applicator head would be positioned to fit into a reservoir having two interior spaces (1*c*, 1*c*'). FIG. 22 shows an applicator head divided into three sections (4*c*, 4*c*', 4*c*"). FIG. 23 shows how this applicator head would be positioned to fit into a reservoir having three interior spaces (1*c*, 1*c*', 1*c*").

The applicator (2) may further comprise a sealing disk (2*a*) that is sandwiched between the handle (3) and the applicator head (4), and that is sized to fit snugly against the perimeter (1*a*) of the reservoir (1). The sealing disk helps to seal the reservoir and contain the product prior to use. The sealing disk may be molded separately from the handle (3) and applicator head (4), and sandwiched between them during assembly (as in FIG. 12). Alternatively, the sealing disk may be integrally molded with either one of those. For example, in FIGS. 13-15, the sealing disk is integral with the handle, while in FIG. 16, it is associated with the applicator head. The perimeter of the sealing disk matches the shape of the perimeter (1*a*) of the reservoir. The two perimeters may be sized for an interference fit of the sealing disk in the reservoir. If provided, this interference is enough to seal the product in the reservoir from the ambient environment, but not so tight that a user cannot pull the applicator out of the reservoir, that is to say, the sealing disk is removable by a user.

Figures 24A, 24B, 24C:
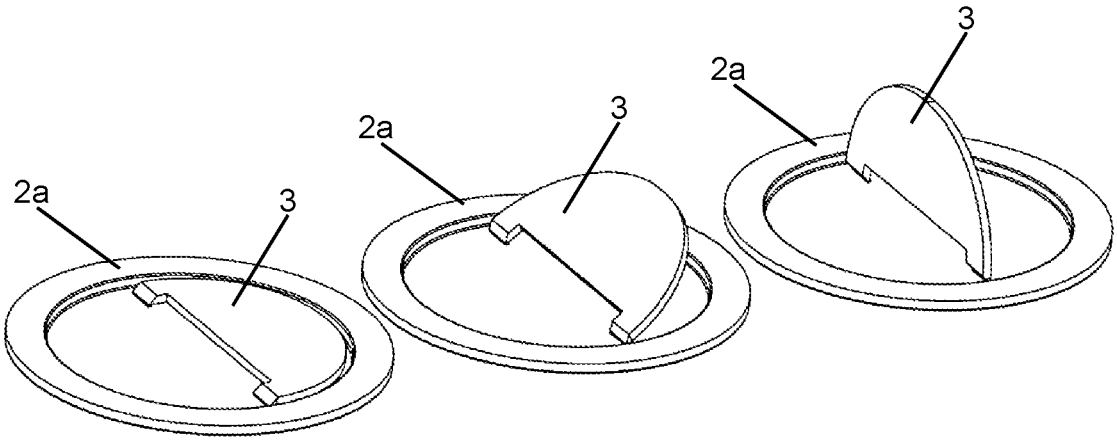
FIGS. 24A, 24B and 24C show an embodiment of the handle (3) wherein the handle is attached to the sealing disk (2*a*) by hinge mechanism.

Optionally, but preferably, the handle (3) is able to lie flat. In FIGS. 24A, 24B and 24C, the handle is attached to the sealing disk (2*a*) by hinge mechanism, such as a living hinge molded at the joining of the handle and sealing disk. When not in use, the handle lies flat against the sealing disk, but can be rotated 90° during use. One advantage to having the handle lie flat is that a barrier seal (8), such as a foil substrate, may be easily applied to the flange (1*b*) of the reservoir. Otherwise, when the handle is in a raised position, the barrier substrate seal would have to be cut to fit over the handle, making the application of a barrier seal more complicated. Other than a living hinge, the handle and sealing disk may be separately molded and joined with any suitable sort of pinned hinge mechanism.

Figure 25A:
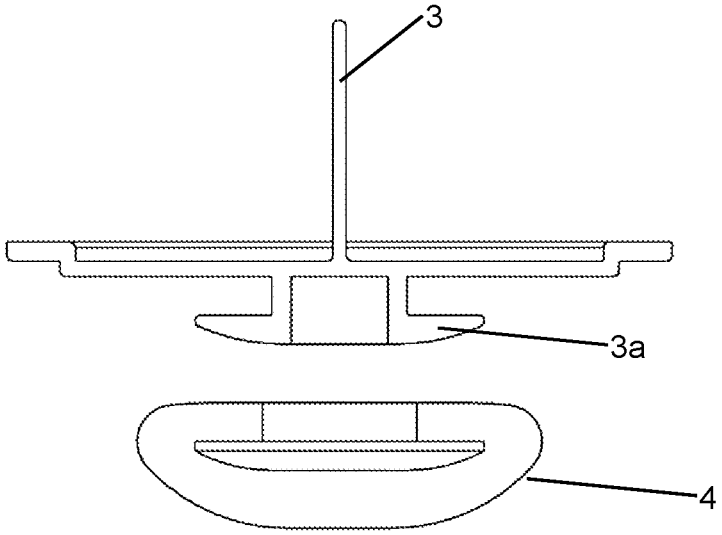
FIGS. 25A, 25B, 26 and 27 depict sponge applicator heads (4), and various means of attaching the applicator heads to the handle (3).
Figure 25B:
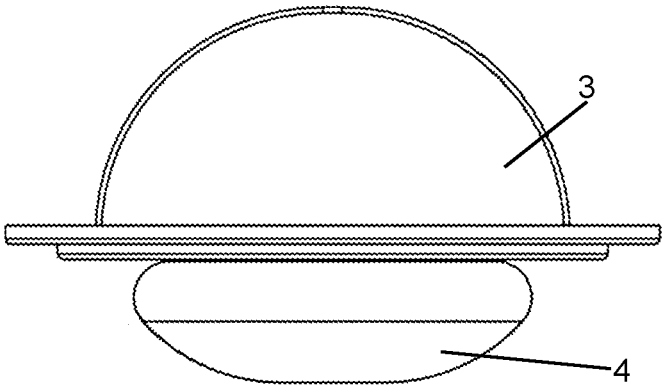
Figure 26:
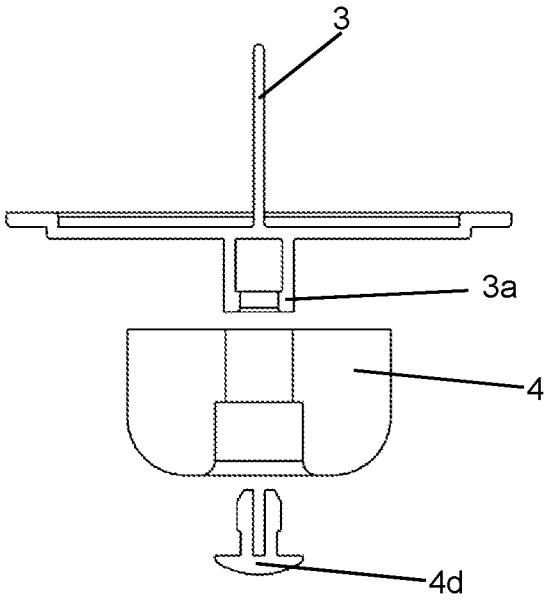
Figure 27:
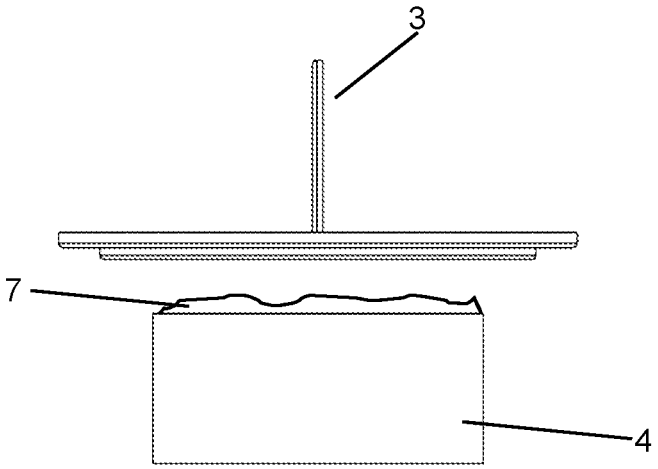

The applicator head (4) may be a plastic molded surface as shown in FIGS. 12-23. Alternatively, the applicator head may comprise one or more sponges. Some embodiments are shown in FIGS. 25A-27. In FIGS. 25A and 25B, a sponge applicator head (4) stretches around a stem (3*a*) of the handle (3). In FIG. 26, a sponge that has a central bore is mounted to a stem (3*a*) of the handle (3) and held in place by a pin (4*d*), as shown. The pin is retained in the stem by a snap or friction fitting. In FIG. 27, a sponge applicator head (4) is attached to a handle (3) by adhesive (7). Other means, such as welding, may also be used to affix the applicator head to the handle. Also contemplated are applicator heads that comprise at least one molded plastic section and at least one sponge section.

The Product

The unit dose package of the present invention is designed to house and apply frozen cosmetic or personal care products. A reservoir (1) according to the invention, as described above, is filled with one or more products (P) that are non-solid when dispensed into the reservoir. Such product types include liquids, semi-liquids, gels, creams, lotions, pomades, etc. At the time of filling into the reservoir, the product must be sufficiently soft to allow a bare applicator head (4) to penetrate into the product, and sufficiently flowable to enclose around the applicator head and make continuous contact with the applicator head. At least one of the products in the one or more spaces (1*c*, 1*c*', 1*c*") of the reservoir must have a freezing point of no lower than −20° C., preferably no lower than −15° C., more preferably no lower than 0° C.

Filling and Using

A reservoir (1) may be filled by any means known in the field of personal care products, such as being dispensed under pressure through a filling nozzle. Most typically, the product will be filled in a liquid state at a temperature well above the freezing point of the product. Once all of the one or more spaces (1*c*, 1*c*', 1*c*") of the reservoir are filled with non-solid product (P), the bare applicator head (4) of an applicator (2) is inserted into the non-solid product until the sealing disk (2*a*) fits snugly against the perimeter (1*a*) of the reservoir. The perimeter of the sealing disk matches the shape of the perimeter (1*a*) of the reservoir, and helps to seal the reservoir and contain the product prior to use.

As noted above, each reservoir (1) has a flange (1*b*) that extends out from the perimeter of the reservoir. Preferably, a barrier seal (8) is affixed to the flange of the reservoir to provide either a primary or secondary seal of the reservoir. The barrier seal is a flexible, air-impermeable substrate that is detachably attached to the flange of the reservoir, and possibly to the sealing disk (2*a*). The barrier seal may be fashioned from paper, plastic, metal foil or any layered combination of these. Typically, the barrier seal will be glued or welded to the flange or sealing disk.

Figure 28:
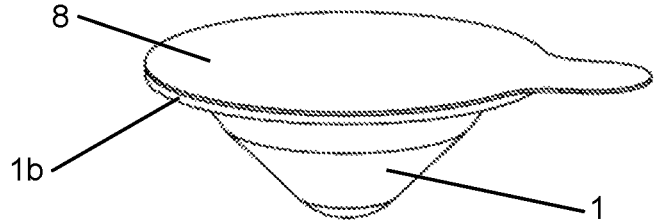
FIG. 28 shows a barrier seal (8) without a cutout (8*a*) placed over a filled product reservoir (1).
Figure 29:
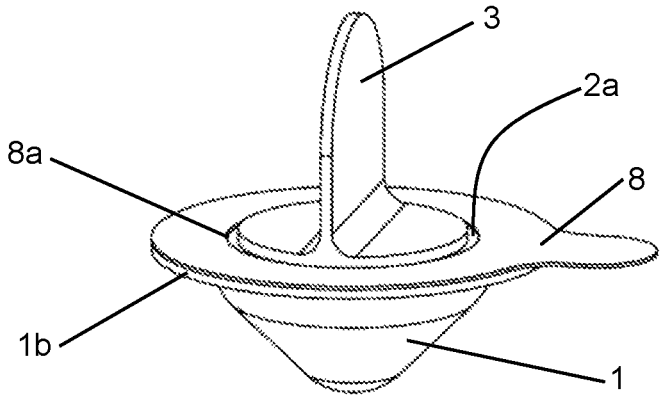
FIG. 29 shows a barrier seal (8) with a cutout (8*a*) placed over a filled product reservoir (1).

In FIG. 28, the handle of the applicator lies flat. This allows the barrier seal (8) to cover the entire opening of the reservoir (1). In this case, the barrier seal will only need to be glued to and/or welded to the flange (1*b*) of the reservoir. The glue or welding must be applied completely around the flange, as a ring, for example. However, when the handle (3) of the applicator (2) does not lie flat, or for other reasons, the barrier seal (8) may be designed with a cutout (8*a*) to accommodate the handle (see FIG. 29). In this case, in order to ensure that the product in the reservoir is protected from the ambient environment, two separate applications of glue or welding are required; one application will be between the barrier seal (8) and the flange (1*b*) of the reservoir, and the second application will be applied between the barrier seal and the sealing disk (2*a*). In either case, the glue or welding can be broken by a user who intentionally peels the barrier seal off of the reservoir (1).

Figure 30:
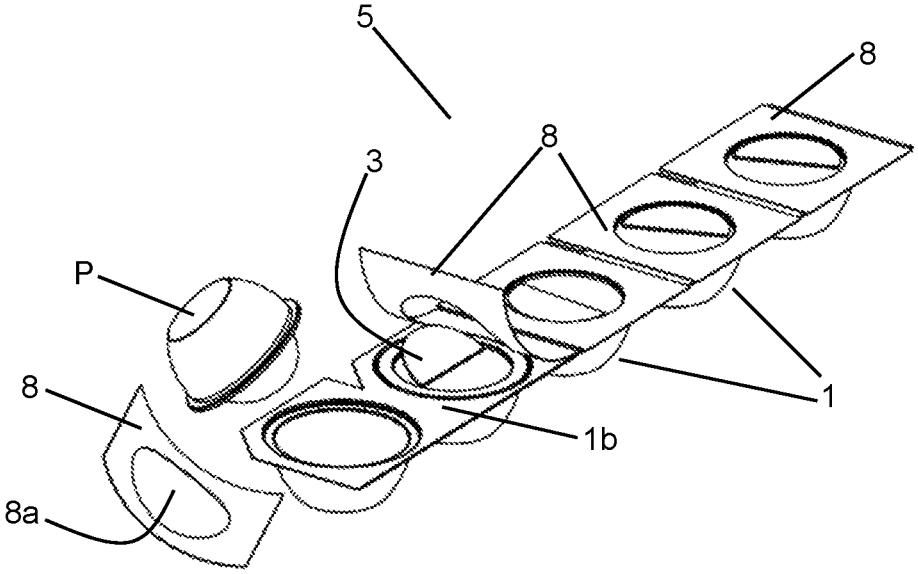
FIG. 30 illustrates the use of a strip (5) of multiple reservoirs (1).

FIG. 30 shows multiple reservoirs (1) joined together into a single strip (5). In this embodiment, the reservoirs are not joined by a breakaway feature (1*i*), in contrast to FIG. 8. Rather, each reservoir is sealed by a separate barrier seal (8), which allows only one reservoir to be unsealed at a time. Also, in this embodiment, even though the handles (3) are able to lie flat, each barrier seal has a cutout (8*a*).

There is no need to immediately freeze the filled packages. Generally, the filled and sealed reservoirs (1) may be shipped at ambient temperatures, so that the product (P) in the reservoirs is not frozen. This greatly simplifies the handling and distribution process, compared, for example, to the disclosure of U.S. Pat. No. 4,378,025 which calls for rapid and intensive cooling to −25° C. to −80° C. at the time of filling, and maintaining the frozen state until use. With the present invention, when the consumer intends to use the product, she will have to store the reservoirs in a freezer for a time sufficient to freeze the product. Upon freezing, the product will adhere to the applicator head (4). When a user wants to apply the product which has previously been frozen, she peels the barrier seal (8) off of one of the reservoirs, grasps the applicator handle (3) and lifts the frozen product out of the reservoir. The frozen product is drawn across the skin at those locations where it is desired to be applied. As the surface of the product melts from the heat of the skin, the product is spread onto the skin. Product may be applied until all or most of the product is applied. Once all or enough product has melted off of the applicator head, the bare, contoured surface of the applicator head contacts the skin, and is able to provide one or more effects, such as a massage effect, an exfoliation effect, and an effect of driving active ingredients into the skin. Also, the bare applicator head may also be used to smooth, dress up or otherwise work the product as desired. Once application is complete, the applicator is discarded. Alternatively, if not all of the product is used up, and if it has not all melted, then the applicator may be returned to the reservoir for storing in a freezer. Preferably, however, the amount of product in one reservoir is sufficient for only a single use, after which the applicator is discarded.

What is claimed is:

1. A unit dose package for a personal care product wherein the package is designed to house and apply a single dose of frozen product that can provide a significant chilling effect during application, the package comprising:

a reservoir (1) that comprises:

a wall (1*d*) that comprises an interior surface that has indentations, polygonal facets or a combination thereof, and that defines an interior space (1*c*) that has a volume;

a perimeter (1*a*) that defines an opening in the wall;

a flange (1*b*) that extends outwardly from the perimeter of the opening;

from 1 mL to 20 mL of a personal care product (P) disposed in the interior space (1*c*) of the reservoir (1), wherein the product is a liquid or semi-liquid at standard atmospheric pressure and temperature, and freezes at no lower than −20° C.; and an applicator (2) that comprises:

a handle (3);

an applicator head (4) that depends from the handle and that is disposed in the personal care product (P) located in the reservoir (1), and that has an outer surface (4*a*) with textural features (4*b*); and a sealing disk (2*a*) that is sandwiched between the handle (3) and the applicator head (4), and that fits snugly against the perimeter (1*a*) of the reservoir (1) to seal the product (P) in the interior space (1*c*) of the reservoir;

wherein, when the product (P) is frozen, a user is able to grasp the handle (3) and lift the product out of the reservoir.

2. The unit dose package of claim 1 wherein:

the reservoir (1) is interiorly divided into two or more interior spaces (1*c*, 1*c*', 1*c*");

a different personal care product is disposed in each interior space; and the applicator head (4) is divided into as many sections (4*c*, 4*c*', 4*c*") as there are interior spaces (1*c*, 1*c*', 1*c*")of the reservoir, so that each interior space of the reservoir houses a section of the applicator head.

3. The unit dose package of claim 1 wherein the flange (1*b*) has at least one straight edge (1*h*).

4. A set of unit dose packages, the set comprising two or more unit dose packages according to claim 3 that are joined together along the at least one straight edge (1*h*) of the flange (1*b*).

5. The set of unit dose packages according to claim 4 wherein the unit dose packages are joined with a breakaway feature (1*i*) that allows individual reservoirs to be separated from the set.

6. A set of disconnected unit dose packages, the set comprising two or more unit dose packages according to claim 1 and a tray (6) that houses the disconnected unit dose packages.

7. The unit dose package of claim 1 wherein the outer surface (4*a*) of the applicator head (4) comprises grooves, indentations, raised dimples or combinations thereof.

8. The unit dose package of claim 1 wherein the handle (3) is attached to the sealing disk (2*a*) by hinge mechanism that enables the handle to lie flat against the sealing disk or be rotated 90° .

9. The unit dose package of claim 1 further comprising a barrier substrate (8) applied to the flange (1*b*) of the reservoir (1).

10. The unit dose package of claim 1 wherein the applicator head (4) comprises one or more sponges.

11. A method of applying a frozen personal care product comprising the steps of:

providing a unit dose package as claimed in claim 9, wherein the product (P) is in a liquid or semi-liquid state;

storing the unit dose package in a freezer for a time sufficient to freeze the product (P) in the reservoir (1);

peeling the barrier seal (8) off of the reservoir (1);

grasping the applicator handle (3) and lifting the frozen product (P) out of the reservoir (1);

spreading product (P) on the skin of a user by drawing the frozen product across the skin, such that the surface of the product melts from the heat of the skin;

continuing the step of spreading until the product has been depleted from the applicator head so that bare spots of the applicator head are able to contact the skin of a user; and using the bare applicator head (4) to dress up the product (P).

* * * * *